US006313798B1

(12) United States Patent
Bancroft et al.

(10) Patent No.: US 6,313,798 B1
(45) Date of Patent: Nov. 6, 2001

(54) BROADBAND MICROSTRIP ANTENNA HAVING A MICROSTRIP FEEDLINE TROUGH FORMED IN A RADIATING ELEMENT

(75) Inventors: Randy Cecil Bancroft, Denver; Blaine Rexel Bateman, Louisville, both of CO (US); Alexis Uspenski, New Middleton, OH (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/488,883

(22) Filed: Jan. 21, 2000

(51) Int. Cl.[7] ..... H01Q 1/38
(52) U.S. Cl. ..... 343/700 MS; 343/762
(58) Field of Search ..... 343/700 MS, 762, 343/767, 772, 789

(56) References Cited

U.S. PATENT DOCUMENTS

| | | | |
|---|---|---|---|
| 5,155,493 | 10/1992 | Thursby et al. | 343/700 MS |
| 5,734,350 | 3/1998 | Deming et al. | 343/700 MS |

OTHER PUBLICATIONS

Waveguide Handbook by N. Marcuvitz, 1986, pp. 399–402.

*Primary Examiner*—Don Wong
*Assistant Examiner*—James Clinger
(74) *Attorney, Agent, or Firm*—E. C. Hancock; F. A. Sirr; Holland & Hart LLP

(57) ABSTRACT

A microstrip antenna includes a ground plane element and a radiating element. An elongated trough is formed generally in the middle of the radiating element so as to divide the radiating element into two generally equally-sized portions, and in a manner to extend outward from a bottom surface of the radiating element. The trough includes a first side edge, a second side edge, and a bottom surface. A first radiating portion extends from the first side edge, and a second radiating portion extends from the second side edge. The trough provides an elongated microstrip-size element at the bottom surface of the trough. A relatively thin dielectric layer is provided between the bottom surface of the trough and a corresponding portion of the ground plane element, thereby providing that a microstrip transmission line is formed by the bottom surface of the trough, the thin dielectric layer, and the corresponding portion of the ground plane element. A first feed conductor is connected to the ground plane element, and a second feed conductor is connected to the bottom of the trough.

14 Claims, 4 Drawing Sheets

BROADBAND MICROSTRIP ANTENNA HAVING A MICROSTRIP FEEDLINE TROUGH FORMED IN A RADIATING ELEMENT

CROSS REFERENCE TO RELATED APPLICATIONS

U.S. Pat. No. 5,734,350, issued Mar. 31, 1998, entitled MICROSTRIP WIDE BAND ANTENNA, is incorporated herein by reference.

U.S. patent application Ser. No. 09/155,831, filed Oct. 6, 1998 entitled MICROSTRIP WIDE BAND ANTENNA AND RADOME, is incorporated herein by reference.

U.S. Patent application Ser. No. 09/441,529, filed Nov. 16, 1999, entitled WIDE BAND ANTENNA HAVING UNITARY RADIATOR/GROUND PLANE, is incorporated herein by reference.

BACKGROUND OF THE INVENTION

1. Field of the Invention

This invention relates to the field of microstrip antennas. More specifically, this invention relates to a microstrip antenna having a microstrip feed line trough that is integrally formed in the antenna's radiating element.

2. Description of the Related Art

The art provides small patch and microstrip antennas that are generally useful for their limited intended purposes. However, the need remains in the art for a patch antenna that is of simple construction and that provides wide bandwidth operation.

As a feature of the present invention, an antenna having a two-section radiating element is provided, the radiating element having a microstrip feedline trough formed therein.

Uniform rectangular guides having a centered rectangular ridge on one, or both, of its wide sides is known. For example, see the publication WAVEGUIDE HANDBOOK by N. Marcuvitz, 1986, published by Peter Peregrinus Ltd., London, UK.

SUMMARY OF THE INVENTION

This invention provides a new and unusual form of a patch antenna having a wide bandwidth when the antenna is compared to existing patch antennas of a similar physical size. Antennas in accordance with the present invention are of relatively simple construction, and include a microstrip trough structure that is formed within a metal-radiating patch element. In preferred embodiments, the microstrip trough is formed generally in the center of the radiating element so as to divide the radiating element into two generally identical radiating portions.

The bottom of the trough is positioned closely adjacent to a metal ground plane element, to thereby form a pseudo microstrip transmission line by which a feed input is applied to the antenna's two-portion radiating element. A first input feed probe, or a first input feed conductor, is electrically connected to the bottom of the trough, and a second input feed conductor is electrically connected to the ground plane element. For example, the center conductor of a coaxial cable transmission line is connected to the bottom of the trough, and the metal sheath of the coaxial cable is connected to the ground plane element.

In accordance with an embodiment of the invention, a folded or bent radiating element is provided whereby a narrow, linear, elongated, and generally U-shaped cross-section trough is formed by bending, or forming, a rectangular shaped metal (copper) radiating patch generally in its mid-portion, thus providing a first radiating element portion on one side of the trough, and a second radiating element portion on the other side of the trough. In a non-limiting embodiment of the invention, the two radiating element portions are of the same physical shape and size. For example, the two radiating element portions are rectangular or square in shape.

The bottom of the U-shaped trough is located closely adjacent and generally parallel to a metal (copper) ground plane element that underlies the two radiating element portions. The bottom of the trough operates as the antenna's relatively low impedance (50 ohm) microstrip feed line. Since the bottom of the trough is substantially closer to the ground plane element than are the two portions of the radiating element, a shorter feed probe than is traditionally used can be provided to electrically connect to the trough and then to the two radiating elements. This shortness property of the probe operates to control the impedance of the probe in order to provide a good impedance match between the antenna and its feed line. More specifically, this construction and arrangement operates to lower the inductance that is required for a good impedance match, thus allowing the use of existing and well-known commercially-available probe terminating connectors to provide for input feed to the antenna, rather than requiring the use of more complicated structures that are sometimes used to achieve a broad bandwidth patch antenna.

In accordance with a feature of the invention, an input feed network is provided comprising a probe feed, or an edge feed, into the metal microstrip line that includes the bottom of the above-described trough. This microstrip line or trough is integral with the two-portion radiating patch element, and this microstrip line is physically sized in width to be of a desired impedance; for example, 50 ohms. This construction and arrangement of the invention provides an efficient electrical transition from a transmission line, such as a coaxial cable into the antenna, further resulting in a structure that provides a broadband characteristic to the antenna as a whole, in particular to the primary resonant mode in which the antenna operates as a one-half wavelength patch antenna, resulting in a directional radiation pattern over a wide range of frequencies.

Antennas in accordance with the present invention operate in multiple resonant modes within the same physical antenna structure, with a smooth transition being provided between the various resonant modes, where the various modes comprise regions of radiation in particular patterns. The presence of these multiple modes give rise to an overall bandwidth of 50-percent or more, all of the modes being effectively impedance matched by the impedance matching trough construction and arrangement above described. As a result, antennas in accordance with the invention are impedance matched across an extremely large frequency range as compared to known patch antennas of similar physical size. Stated another way, antennas in accordance with the invention, exhibit multiple resonances, all of which are impedance matched to the input feed line.

These and other features and advantages of the present invention will be apparent to those of skill in the art upon reference to the following detailed description, which description makes reference to the drawing.

DESCRIPTION OF THE PREFERRED EMBODIMENTS

Figure 1:
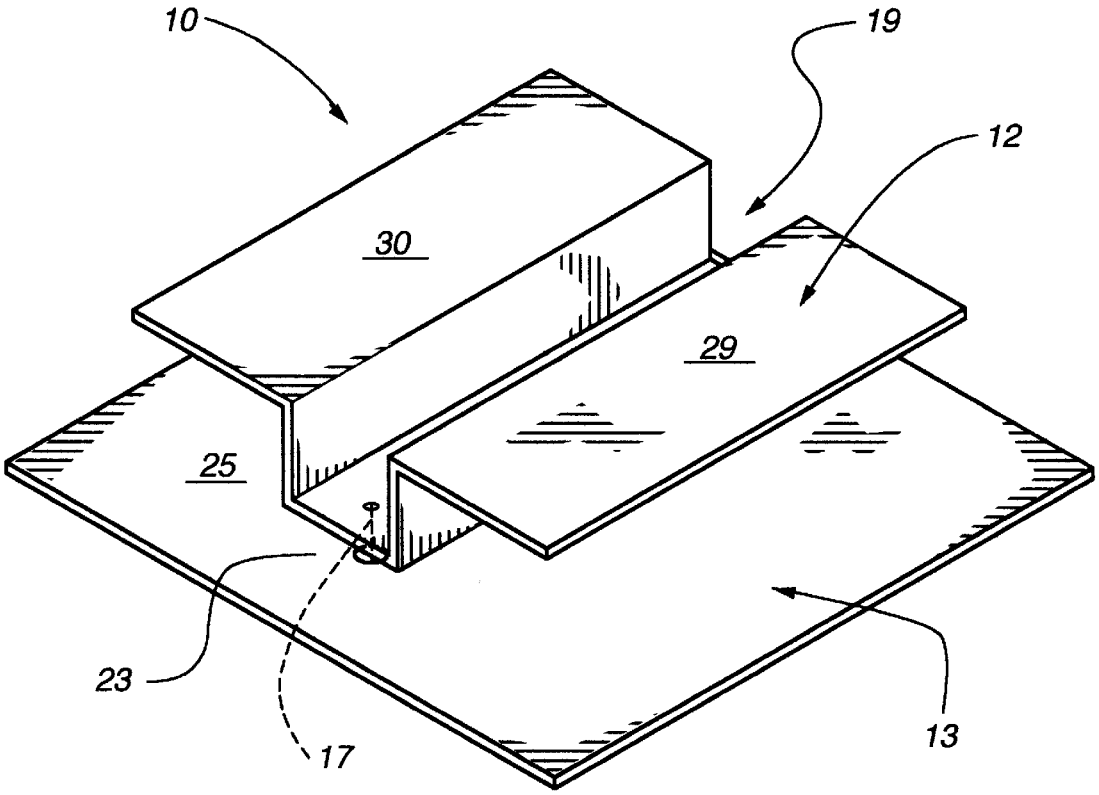
FIG. 1 is a perspective top/front view of a first embodiment of a broadband microstrip patch antenna in accordance with the invention.

FIG. 1 is a top and front-side perspective view of a first embodiment of a broadband antenna 10 in accordance with the invention, antenna 10 having a three-member composite radiating element 12 that is made of two radiating element portions 29, 30, and a centrally-located pseudo microstrip feed line trough 19 having generally a U-shaped cross section.

Figure 2:
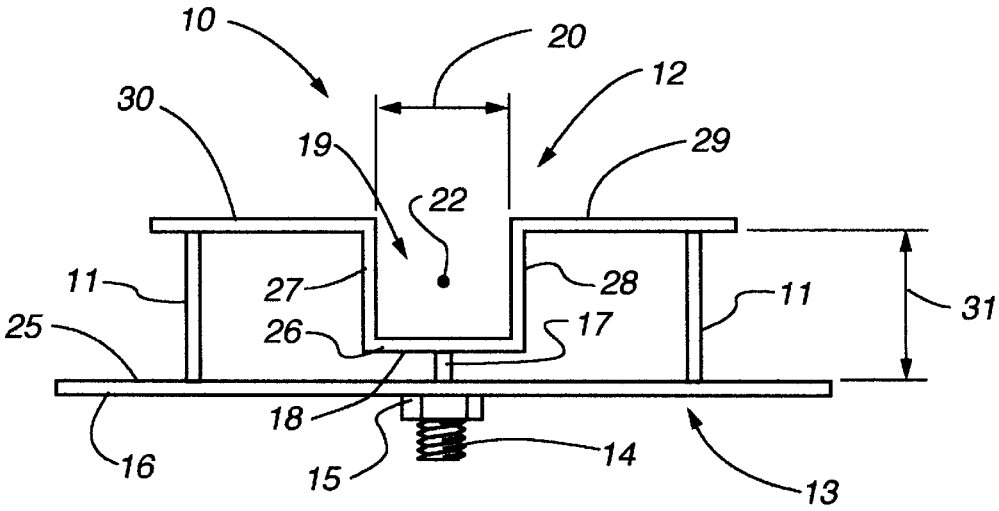
FIG. 2 is a front view of the FIG. 1 embodiment, this figure showing two of the four dielectric space adjustment posts, or bolts, that physically support the antenna generally planar and trough-type metal radiating element above the antenna generally planar metal ground plane element, and this figure showing the generally U-shaped cross section of a pseudo microstrip transmission line that includes the bottom wall of the trough that is formed in the radiating element.

FIG. 2 is a front-side view of antenna 10. FIG. 2 shows two of the four dielectric support and/or adjustment posts or bolts 11 that physically support the antenna trough-type metal radiating element 12 above the antenna metal ground plane element 13. FIG. 2 also shows an electrical connector 14 of the coaxial cable type, the outer metal housing 15 of connector 14 being mounted on, and electrically connected to, the bottom surface 16 of ground plane element 13 , and the centrally located metal conductor or feed probe 17 of connector 14 being electrically connected, or soldered, to the bottom metal surface 18 of trough 19 that is formed in radiating element 12.

While radiating element 12 and ground plane element 13 are specified as being copper members, the spirit and scope of the invention does not require the use to this specific metal. More generally, an electrically conductive metal or a metal-clad composite material that is thick enough to be generally self-supporting is all that is required. For example, it may be desirable for purposes such as lower cost to use a dielectric substrate that is copper-clad on one, or both, sides thereof.

Figure 3:
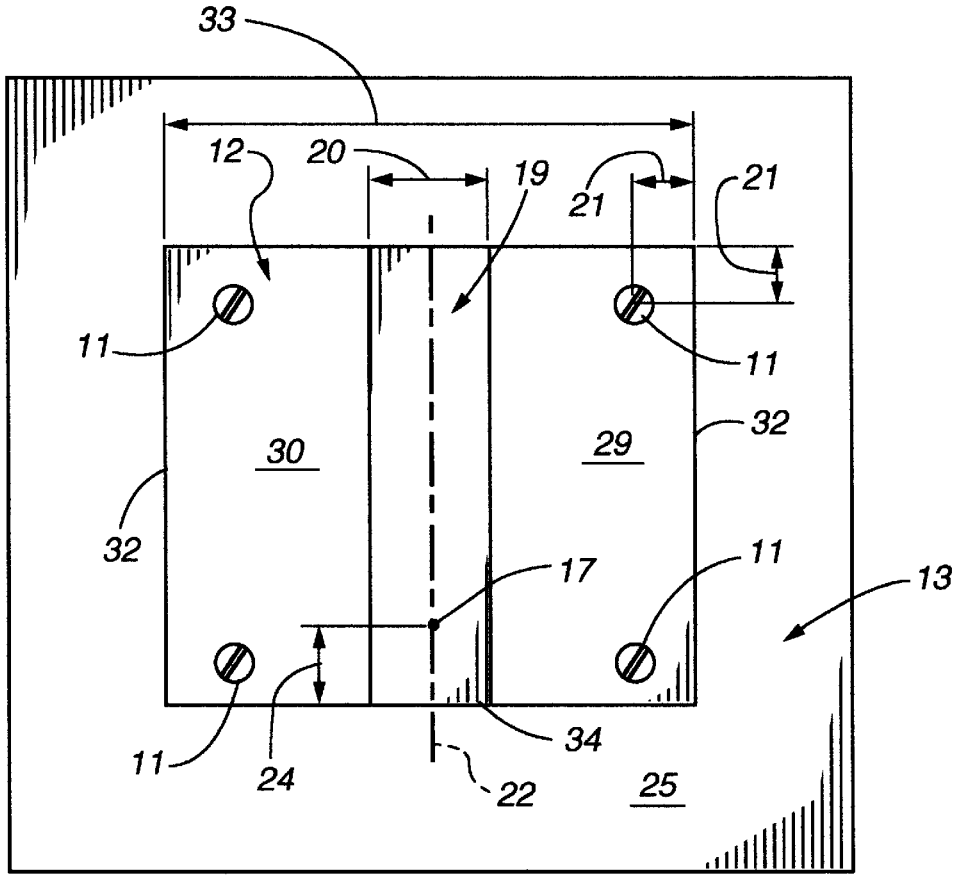
FIG. 3 is a top view of the FIG. 1 embodiment.

FIG. 3 is a top view of antenna 10, this figure showing all four of the dielectric posts 11 that physically space/support radiating element 12 and ground plane element 13 relative to each other. In a non-limiting embodiment of the invention, each of the four posts 11 was located, or spaced, generally 0.3-inch from the adjacent corner of radiating element 12, as shown by dimensions 21 in FIG. 3.

While in a preferred embodiment, radiating element 12 was generally centered over ground plane element 13, as is best seen in FIG. 3, the spirit and scope of the invention is not to be limited to this centered arrangement. All that is required is that any given portion of radiating element 12 be provided with a corresponding underlying portion of ground plane element 13.

The FIG. 1–3 embodiment of the invention provides a broadband microstrip patch antenna 10, wherein the width 20 of the trough 19 that is formed in radiating element 12 is chosen and adjusted to provide a desired microstrip feed line impedance for feeding radiating element 12; for example, a 50 ohm input feed line impedance.

The frequency mode characteristic or property of antenna 10 is broadband in a manner that is similar to that of a ridged waveguide. The use of an electrically small, or short, length feed probe 17 (for example, about 0.1-inch long) desirably provides a decrease in the feed probe inductance at the higher frequency modes of antenna 10. The length of feed probe 17 is frequency dependent in that the higher the frequency of operation of antenna 10, the shorter will be feed probe 17.

In an embodiment of the invention, antenna 10 operated in a broadband frequency range from about 1.50 to about 2.75 GHz, and ground plane element 13 comprised a generally flat or planar copper member that was about 20-mils thick and in the range of from about 4.08 to about 4.75-inch square. Note that the planar shape of ground plane element is not critical to the invention since other shapes can be provided to accomplish the antenna ground plane function.

In this embodiment of antenna 10, the thickness of the air dielectric layer that separated the bottom surface 18 of trough 19 from the top surface 25 of ground plane element 13 was quite thin, and in the range of from about 0.082 to about 0.1-inch, this dimension establishing the length of feed probe 17.

It is to be noted that use of an air dielectric layer is not required by the spirit and scope of the invention. For example, a dielectric plastic material may occupy the space that exists between the bottom surface 18 of trough 19 and the top surface 25 of ground plane element 13.

Radiating element 12 and its trough 19 is also formed of copper that is about 20 mils thick. Trough 19 is made of three structural copper walls, i.e. a narrow bottom wall 26 having a microstrip width 20 in the range of from about 0.481 to about 0.539-inch, and two parallel side walls 27 and 28 that each meet bottom wall 26 at a right angle, i.e. side walls 27 and 28 extend perpendicularly upward from bottom wall 26.

In this embodiment of the invention, radiating element 12 includes two identical size and rectangular-shaped radiating element portions 29 and 30 wherein the long dimension 32 of each rectangle extends parallel to the centrally-located longitudinal axis 22 of trough 19. In an embodiment of the invention, the planar area or size occupied by composite radiating element 12 comprised a rectangle having a long side 32 that was about 2.68-inch long, and having a short side 33 that was about 2.55-inch long.

It is to be noted that within the spirit and scope of the invention, other planar shapes of radiating element portions 29, 30 can be provided, including radiating element portions 29, 30 that are of different individual physical shapes, and/or of different individual planar areas.

Without limitation thereto, radiating element portions 29 and 30 occupy a common flat plane that is generally parallel to a plane that is occupied by ground plane element 13. The plane that is occupied by radiating element portions 29, 30 is spaced from the plane that is occupied by ground plane element 13 by a distance 31 that is in the range of from about 0.430 to about 0.495-inch.

In an alternative embodiment, radiating element portions 29, 30 can occupy two different individual planes that are each tilted to the plane that is occupied by ground plane element 13, as is taught by above cited U.S. Pat. No. 5,734,350.

In accordance with this invention, the three-member structural combination that comprises (1) the microstrip narrow and planar metal bottom wall 26 of trough 19, (2) the corresponding thin and microstrip narrow and planar dielectric layer 23 (see FIG. 1) that underlies bottom wall 26, and (3) the corresponding microstrip narrow and planar underlying metal portion of ground plane element 13, operates as a pseudo microstrip transmission line that is constructed and arranged to provide impedance matching to an antenna feed line and probe 17 that are connected to connector 14. For example, 50 ohm impedance matching is provided between antenna 10 and a coaxial feed cable (not shown) that is connected to connector 14. This three-member microstrip transmission line also operates somewhat like a ridged waveguide. It is to be noted that the thinness parameter of dielectric layer 23 is directly related to the length of feed probe 17, this thinness parameter operating to control, at least in a major part, the impedance of the three-member microstrip transmission line, and this thinness parameter of dielectric layer 23 also enabling the use of a short-length feed probe 17, thus contributing to the antenna's broadband characteristic.

While the bottom wall 26 of trough 19 is preferably a planar wall that extends parallel to the plane that is occupied by ground plane element 13, the spirit and scope of the invention is not to be limited thereto. For example, bottom wall 26 may comprise an outwardly-convex curved surface, and preferably a convex curved surface that is formed about an axis that extends parallel to the plane that is occupied by ground plane element 13.

The physical location whereat feed probe 17 is electrically connected to the bottom wall 26 of trough 19 is not critical to the invention. In an embodiment of the invention, feed probe 17 was centrally-located on the width 20 of trough 19, and feed probe 17 was located at a distance 24 that was in the range of from about 0.425 to about 0.470-inch from the front edge 34 of trough 19. It is within the spirit and scope of the invention to provide an edge-type electrical feed connection to radiating element 12 by way of an electrical connection to edge 34; for example, by way of a microstrip line (not shown) that connects to edge 34.

While no radome is shown relative to this first embodiment, a radome of the type described in above-mentioned copending patent application Ser. No. 09/155,831 can be used to good advantage.

Figure 4:
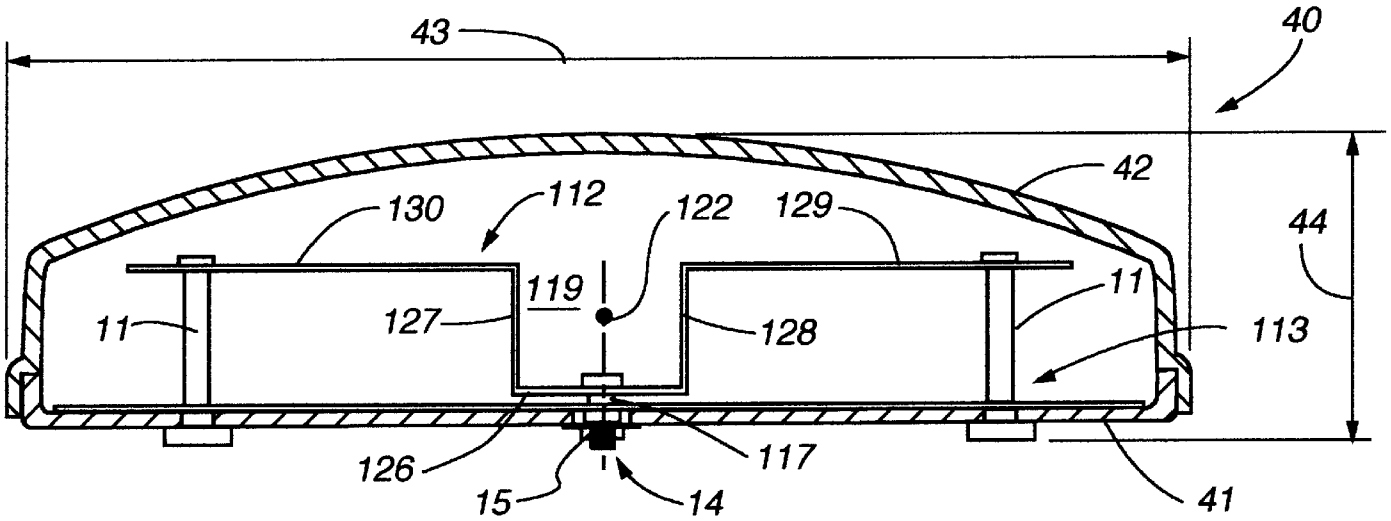
FIG. 4 is a front-side view of a second embodiment of a broadband microstrip patch antenna/radome assembly in accordance with the invention, the base and cover of the radome being shown in section in order to expose a patch antenna of the type above described relative to FIGS. 1–3.

FIG. 4 is a front-side view of a second embodiment of a broadband microstrip patch antenna/radome assembly 40 in accordance with the invention, this assembly including a plastic radome having a base portion 41 and a cover portion 42. A non-limiting and example size of antenna/radome assembly 40 is about 8.81-inch wide and about 2.22-inch high, as is represented respectively by dimension 43 and 44 in FIG. 4, and about 11.19-inch long, as is represented by dimension 45 in FIG. 5.

Figure 5:
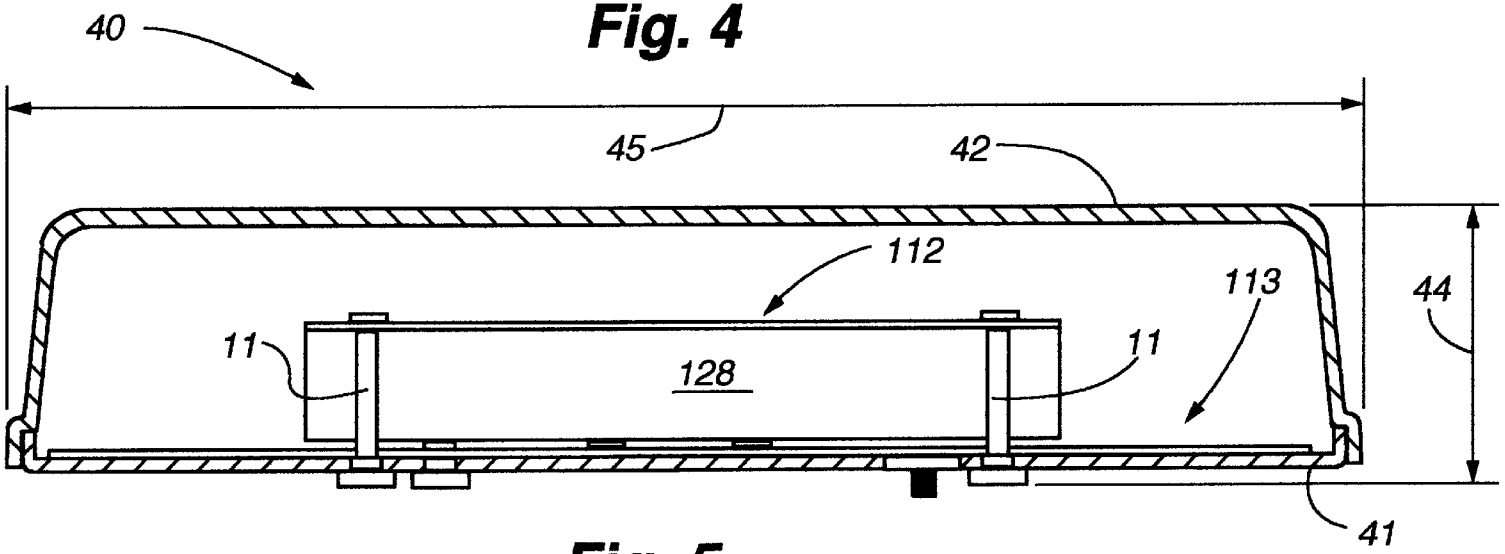
FIG. 5 is a side view of the antenna/radome assembly of FIG. 4 wherein the base and cover of the radome is again shown in section.

In FIGS. 4 and 5, radome 41, 42 is shown in section in order to expose a metal and generally planar ground plane element 113 and a metal trough-type radiating element 112, both of which are constructed and arranged as above-described relative to ground plane element 13 and radiating element 12 shown in FIG. 1. By way of example only, radome 41, 42 may comprise a white, vacuum formed, textured side out, acrylonitrile butadiene styrene copolymer (ABS resin) that is about 3/32-inch thick.

Figure 6:
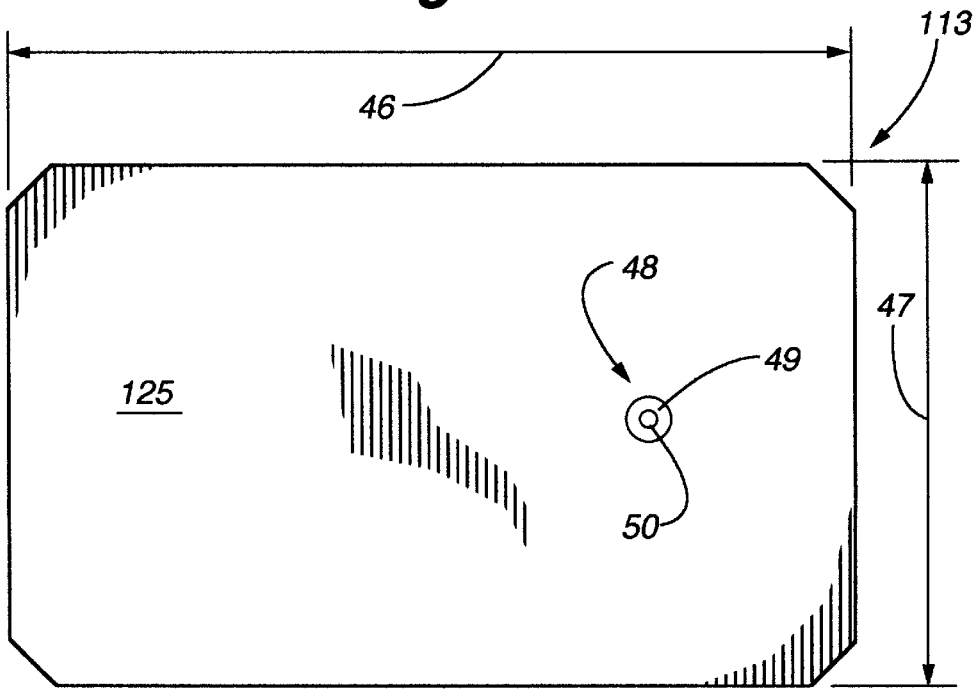
FIG. 6 is a top view of the ground plane element of the antenna of FIG. 4.

FIG. 6 is a top view of the ground plane element 113 that is housed or sealed within radome assembly 41, 42. In this embodiment of the invention, dimension 46 of FIG. 6 was about 10.50-inch, and dimension 47 was about 8.13-inch. In this embodiment of the invention, ground plane element 113 is a rigid dielectric substrate having a thin layer of copper on both sides thereof.

The top copper layer 125 (i.e., the copper layer that faces radiating element 112) of ground plane element is processed at an annular area 48 having a diameter of about 0.50-inch in order to remove that annular portion of top copper layer 125, thus exposing dielectric substrate 49. A through hole 50 of about 0.10-inch diameter is formed through ground plane element 113. Through hole 50 provides for the passage of an electrical feed conductor that electrically connects to the bottom surface 126 of the trough 119 that is formed in radiating element 112, as above described relative to the FIG. 1–3 embodiment of the invention (in this case, by way of a simple and inexpensive soldering operation).

In order to aid in the support of radiating element 112 at the soldering portion thereof, a hollow brass tube 117, having an length of about 0.50-inch and having an outer diameter of about 0.094-inch, is provided. The annular bottom surface of brass tube 117 physically engages dielectric substrate area 49, and is thus electrically insulated from top copper surface 125, whereas the top annular surface of brass tube 117 physically engages and electrically connects to the bottom surface 126 of metal trough 119 that is formed in radiation element 112.

Figure 7:
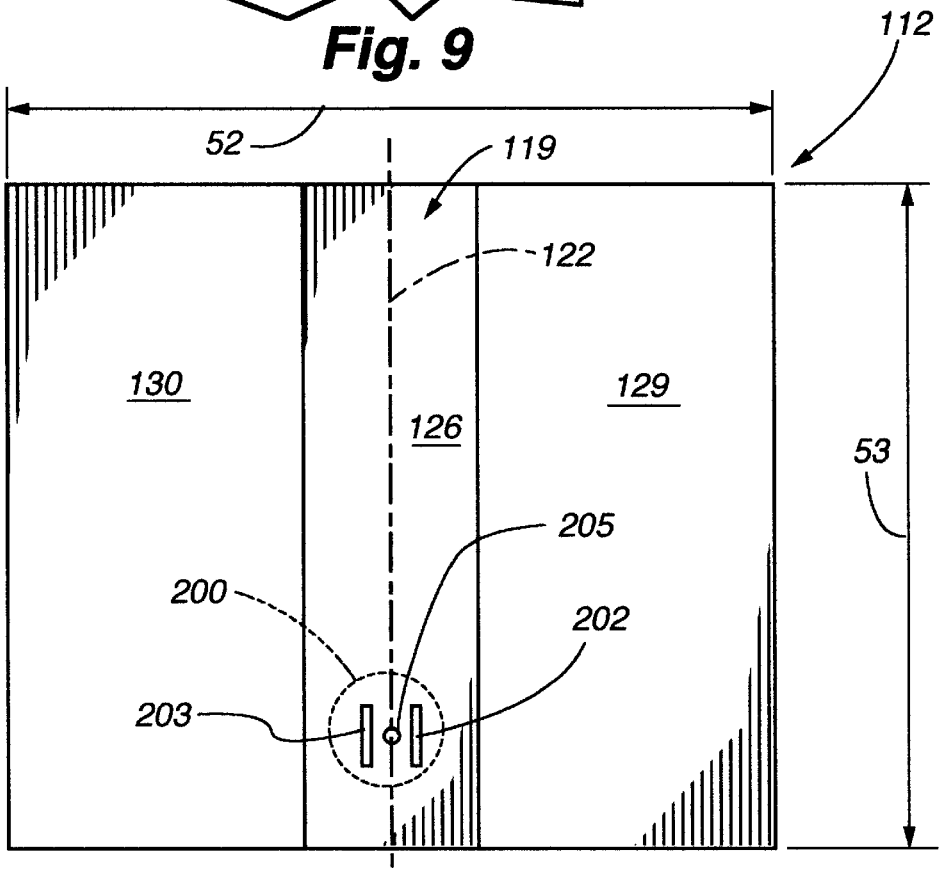
FIG. 7 is a top view of the radiating element of the antenna of FIG. 4.
Figure 8:
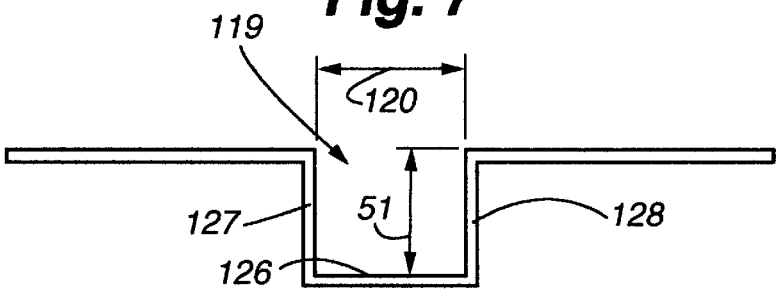
FIG. 8 is an enlarged view of the end of the microstrip trough that is formed in the FIG. 7 radiating element.

FIG. 7 is a top view of the trough-type radiating element 112 of antenna/radome assembly 40, and FIG. 8 is an enlarge view of the front side of the copper trough 119 that is formed by walls 126, 127, 128 that are formed in radiating element 112. In this embodiment of the invention, the dimension 52 of radiating element 112 that extends generally perpendicular to the axis 122 of trough 119 was about 7.00-inch, whereas dimension 53 that extends generally parallel to the axis 122 of trough 119 was about 6.22-inch. Again, radiating element 112 was generally centered over ground plane element 113, as best seen in FIGS. 4 and 5.

In this embodiment of the invention, the microstrip width 120 of trough 119 was about 1.250-inch, and the height 51 of the two side walls 127, 128 was about 0.920-inch. Again, the width parameter of trough 119 is selected to provide impedance matching to the antenna feed means.

Figure 9:
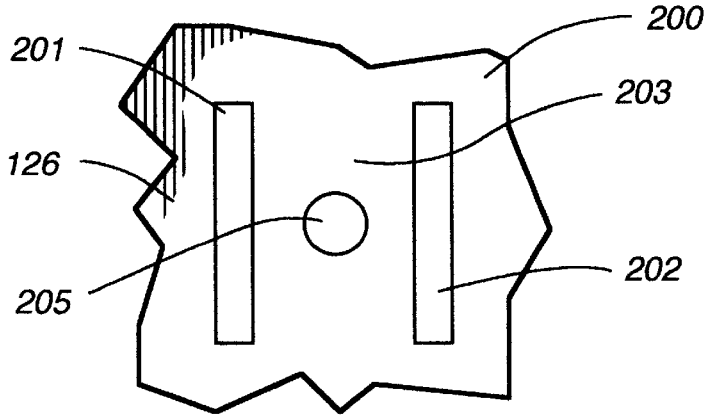
FIG. 9 is an enlarged view of the soldering area that is provided in the microstrip trough of the FIG. 7 radiating element.

FIG. 9 is an enlarged view of a soldering area 200 that is provided in the bottom wall 126 of the trough 119 of radiating element 112. As is taught by above-cited copending patent application Ser. No. 09/441,529, soldering area 200 includes a pair of parallel and generally equal size through slots 201 and 202 that thermally isolate the metal (copper) area 203 that exists between the two slots 201, 202. A small through hole 205 is provided in bottom wall 126 of trough 119. A feedline metal electrical conductor (not shown in FIG. 9) extends upward through hole 205, and this conductor is soldered to the top surface of bottom wall 126. The thermal isolation that is provided by slots 202, 203 is such that the heat sink characteristic of solder area 203 is considerably reduced, and as a result, simple and low cost soldering procedures can be used to solder thin conductor to the top surface of bottom wall 126. As is taught by this copending patent application, slots 202, 203 preferably extend parallel to the direction in which current flows in bottom wall 126 of trough 119. In this embodiment of the invention, through slots 202, 203 were about 0.5-inch long and about 0.045-inch wide, and slots 202, 203 were spaced from each other by about 0.25-inch, to thus provide a rectangular-shaped soldering area 203 that measured about 0.5×0.25-inch.

The invention has been described while making detailed reference to preferred embodiments thereof. However, since it is known that others skilled in the art will, upon learning of the invention, readily visualize yet other embodiments that are within the spirit and scope of the invention, this detailed description is not to be taken as a limitation on the spirit and scope of the invention.

What is claimed is:

1. A microstrip antenna, comprising:

a generally planar ground plane element having a top metal surface;

an elongated and generally planar microstrip element having first and second generally parallel side edges that are spaced by a generally uniform width;

a bottom metal surface on said microstrip element;

said bottom metal surface of said microstrip element being spaced a given distance from said top metal surface of said ground plane element and being generally parallel to said top metal surface of said ground plane element;

a dielectric layer intermediate said bottom metal surface of said microstrip element and said top metal surface of said ground plane element;

said bottom metal surface of said microstrip element defining a microstrip transmission line in combination with a dimensionally corresponding portion of said dielectric layer, and a dimensionally corresponding portion of said top metal surface of said ground plane element, a first and a second metal wall respectively extending upward from said first and second side edges of said bottom metal surface of said microstrip element;

said first and second metal walls each having a top edge;

a first and a second metal radiating element respectively extending from said top edge of said first metal wall and from said top edge of said second metal wall;

said first and second metal radiating elements being spaced from said top metal surface of said ground plane element by a distance that is greater than said given distance;

a first metal conductor connected to said metal ground plane element;

and a second metal conductor connected to said bottom metal surface of said microstrip element.

2. The microstrip antenna of claim 1 wherein said microstrip antenna operates at a given frequency, and wherein said given distance is an inverse function of a magnitude of said given frequency.

3. The microstrip antenna of claim 1 wherein said first and second metal radiating elements are generally parallel to said top metal surface of said ground plane element.

4. The microstrip antenna of claim 1 wherein said first and second metal radiating elements lie in a common plane that is generally parallel to said top metal surface of said ground plane element.

5. The microstrip antenna of claim 1, including:

a first and a second transversely aligned and generally parallel through slot formed in said bottom metal surface of said microstrip element, said first and second through slots extending in a direction of elongation of said microstrip element, said first and second through slots defining a soldering area between said first and second through slots, and said second metal conductor being soldered to said soldering area.

6. The microstrip antenna of claim 1 wherein said dielectric layer is an air dielectric layer.

7. The microstrip antenna of claim 6 wherein said antenna operates at a given frequency, and wherein said given distance is an inverse function of a magnitude of said given frequency.

8. The microstrip antenna of claim 7 wherein said first and second metal radiating elements lie in a common plane that is generally parallel to said ground plane element.

9. The microstrip antenna of claim 8 wherein said top metal surface of said ground plane element underlies all portions of said microstrip element and said first and second metal radiating elements.

10. The microstrip antenna of claim 9, including:

a first and a second transversely aligned and generally parallel through slot formed in said bottom metal surface of said microstrip element, said first and second through slots extending in a direction of elongation of said microstrip element, said first and second through slots defining a soldering area between said first and second through slots, and said second metal conductor being soldered to said soldering area.

11. The microstrip antenna of claim 10, including:

a radome housing for said ground plane element and said first and second radiating elements.

12. An antenna, comprising:

a metal ground plane element having a top and a bottom surface;

a metal radiating element having a top and a bottom surface, an elongated trough formed in said radiating element in a manner to extend outward from said bottom surface of said radiating element;

said elongated trough having a first side edge, a second side edge, and a bottom surface;

said elongated trough defining a first radiating portion that extends from said first side edge of said elongated trough;

said elongated trough defining a second radiating portion that extends from said second side edge of said elongated trough;

said elongated trough providing an elongated microstrip element at said bottom surface of said elongated trough;

support means for supporting said bottom surface of said radiating element above said top surface of said ground plane element;

a dielectric space between said bottom surface of said radiating element and said top surface of said ground plane element;

said bottom surface of said elongated trough being spaced from a corresponding portion of said top surface of said ground plane element by a relatively thin dielectric layer, to thereby define a microstrip transmission line that comprises said bottom of said elongated trough, said thin dielectric layer and said corresponding portion of said ground plane element;

a first feed conductor connected to said ground plane element;

a second feed conductor connected to said bottom of said elongated trough;

a through hole in said corresponding portion of said ground plane element;

a connector having an external metal housing soldered to said bottom surface of said ground plane element, and having a generally centrally-located metal conductor freely extending through said through hole and soldered to said bottom surface of said elongated trough, such that said external metal housing comprises said first feed conductor and such that said centrally-located metal conductor comprises said second feed conductor;

a pair of laterally spaced, elongated, and generally parallel through slots in said bottom surface of said elongated trough, said through slots extending in a direction of elongation of said trough; and said generally centrally-located metal conductor soldered to said bottom surface of said elongated trough at a location between said pair of through slots.

13. An antenna, comprising:

a planar ground plane element having a top and a bottom surface;

a radiating element having a top and a bottom surface;

an elongated trough formed in said radiating element in a manner to extend outward from said bottom surface of said radiating element;

said elongated trough having a first side edge, a second side edge, and a planar bottom surface;

said elongated trough having a rectangular-shaped planar cross section that extends generally perpendicular to said ground plane element;

said elongated trough defining a first planar radiating portion that extends from said first side edge of said elongated trough;

said elongated trough defining a second planar radiating portion that extends from said second side edge of said elongated trough;

said first and second radiating portions occupying a common plane that is generally parallel to said ground plane element;

said elongated trough providing an elongated microstrip element at a bottom surface of said elongated trough;

support means for supporting said bottom surface of said radiating element above said top surface of said ground plane element;

a dielectric space between said bottom surface of said radiating element and said top surface of said ground plane element;

said bottom surface of said elongated trough being spaced from a corresponding planar portion of said top surface of said ground plane element by a relatively thin dielectric layer, to thereby define a microstrip transmission line that comprises said bottom of said elongated trough, said thin dielectric layer and said corresponding portion of said ground plane element, said corresponding portion of said ground plane element being generally parallel to said bottom surface of said elongated trough;

a first feed conductor connected to said ground plane element; and a second feed conductor connected to said bottom of said elongated trough.

14. The antenna of claim 13 wherein a thickness of said relatively thin dielectric layer is selected as an inverse function of an operating frequency of said antenna.

* * * * *